US010240507B2

(12) United States Patent
Sugiyama et al.

(10) Patent No.: US 10,240,507 B2
(45) Date of Patent: Mar. 26, 2019

(54) EXHAUST DEVICE FOR FOUR-CYLINDER INTERNAL COMBUSTION ENGINE

(71) Applicant: NISSAN MOTOR CO., LTD., Yokohama-shi, Kanagawa (JP)

(72) Inventors: Takanobu Sugiyama, Kanagawa (JP); Hidehiro Fujita, Kanagawa (JP); Takayuki Hamamoto, Kanagawa (JP); Yuta Kanashima, Kanagawa (JP)

(73) Assignee: NISSAN MOTOR CO., LTD., Yokohama-shi, Kanagawa (JP)

( * ) Notice: Subject to any disclaimer, the term of this patent is extended or adjusted under 35 U.S.C. 154(b) by 3 days.

(21) Appl. No.: 15/516,689

(22) PCT Filed: Oct. 9, 2014

(86) PCT No.: PCT/JP2014/077068
§ 371 (c)(1),
(2) Date: Apr. 4, 2017

(87) PCT Pub. No.: WO2016/056101
PCT Pub. Date: Apr. 14, 2016

(65) Prior Publication Data

US 2017/0298803 A1 Oct. 19, 2017

(51) Int. Cl.

| | |
|---|---|
| ***F01N 3/00*** | (2006.01) |
| ***F01N 13/10*** | (2010.01) |
| ***F02F 1/42*** | (2006.01) |
| ***F02F 1/24*** | (2006.01) |

(52) U.S. Cl.
CPC ..... *F01N 13/10* (2013.01); *F02F 1/243* (2013.01); *F02F 1/42* (2013.01); *F02F 2001/4278* (2013.01)

(58) Field of Classification Search
USPC ..... 60/272, 302, 305, 312, 313, 314, 320, 60/322, 323
See application file for complete search history.

(56) References Cited

U.S. PATENT DOCUMENTS 6,962,048 B2 * 11/2005 Ashida ..... F01N 13/1805 60/299
7,520,127 B2 * 4/2009 Ashida ..... F01N 3/28 60/305
8,079,214 B2 * 12/2011 Son ..... F01N 13/10 60/323

(Continued)

FOREIGN PATENT DOCUMENTS

JP 2008-038838 A 2/2008

*Primary Examiner* — Binh Q Tran
(74) *Attorney, Agent, or Firm* — Drinker Biddle & Reath LLP

(57) ABSTRACT

In an in-line four-cylinder internal combustion engine, exhaust ports (2*b*, 2*c*) of cylinders #2 and #3 merge together inside a cylinder head and become open as one flat collective exhaust port (2*bc*). An exhaust manifold (5) includes separate individual exhaust pipes (6, 7) for cylinders #1 and #4 and a collective exhaust pipe (8) for cylinders #2 and #4. Tip ends of these three exhaust pipes are connected to a catalytic converter (11). An equivalent diameter of the collective exhaust port (2*bc*) is larger than equivalent diameters of the exhaust ports (2*a*, 2*d*) before merging. A short diameter of the collective exhaust port (2*bc*) is smaller than or equal to the equivalent diameters of the exhaust ports (2*b*, 2*c*).

5 Claims, 7 Drawing Sheets

(56) References Cited

U.S. PATENT DOCUMENTS

| | | | | |
|---|---|---|---|---|
| 8,256,402 | B2 * | 9/2012 | Yamagata | F01N 13/10 123/559.1 |
| 9,574,522 | B2 * | 2/2017 | Moran | F02F 1/243 |
| 2010/0126153 | A1 * | 5/2010 | Nagafuchi | F01N 13/001 60/299 |
| 2010/0251704 | A1 * | 10/2010 | Asame | F02F 1/243 60/323 |

* cited by examiner

EXHAUST DEVICE FOR FOUR-CYLINDER INTERNAL COMBUSTION ENGINE

FIELD OF THE INVENTION

The present invention relates to an exhaust device for an in-line four-cylinder internal combustion engine and, more particularly, to an exhaust device of the type having at least one collective exhaust port into which exhaust ports of a pair of cylinders discontinuous in firing order merge together inside a cylinder head.

BACKGROUND ART

Patent Document 1 discloses an exhaust device for an in-line four-cylinder internal combustion engine, in which exhaust ports of cylinders #2 and #3 discontinuous in firing order merge together inside a cylinder head; and exhaust ports of cylinders #1 and #1 are respectively open at a side surface of the cylinder head. Namely, the exhaust ports of cylinders #2 and #3 are configured as one collective exhaust port; and the exhaust ports of cylinders #1 and #4 are configured as respective separate individual exhaust ports. The collective exhaust port of cylinders #2 and #3 are connected to a catalytic converter through one collective exhaust pipe. The individual exhaust ports of cylinders #1 and #4 are connected to the catalytic converter through respective separate individual exhaust pipes.

The exhaust device in which the exhaust ports of some cylinders merge together inside the cylinder head is advantageous for early catalyst activation after engine start-up because the temperature of exhaust gas introduced to the catalytic converter through the collective exhaust pipe can be maintained at a high level during cold engine start-up. Further, it is described in Patent Document 1 that the length of the collective exhaust pipe for cylinders #2 and #3 is set shorter than that of the individual exhaust pipes for cylinders #1 and #2 so as to suppress heat radiation from the collective exhaust pipe.

In the exhaust device in which the exhaust ports of some cylinders merge together inside the cylinder head, however, the temperature of exhaust gas introduced to the catalytic converter through the collective exhaust pipe tends to become too high during high-speed high-load engine operation after engine warm-up. This can lead to catalyst deterioration even though the exhaust device is advantageous for early catalyst activation after engine start-up as mentioned above.

Namely, there is a demand to introduce the exhaust gas to the catalytic converter, while maintaining the temperature of the exhaust gas as high as possible, during cold engine start-up for the purpose of early catalyst activation. On the other hand, there is also a demand to suppress the temperature of the exhaust gas introduced to the catalytic converter during high-speed high-load engine operation. It is difficult for the conventional exhaust device to satisfy both of these mutually contradictory demands.

PRIOR ART DOCUMENTS

Patent Document

Patent Document 1: Japanese Laid-Open Patent Publication No. 2008-38838

SUMMARY OF THE INVENTION

According to the present invention, there is provided an exhaust device for an internal combustion engine, the internal combustion engine having four cylinders, at least one pair of which are 360° apart in ignition timing, the exhaust device comprising: a collective exhaust port into which exhaust ports of the one pair of cylinders merge together inside a cylinder head, the collective exhaust port having an opening at one side surface of the cylinder head; and a collective exhaust pipe joined to the collective exhaust port, the collective exhaust pipe and an exhaust pipe for other one of the cylinders being connected to a single catalytic converter, wherein an equivalent diameter of the opening of the collective exhaust port is larger than equivalent diameters of the exhaust ports of the one pair of cylinders before merging; and wherein the opening of the collective exhaust port has an elliptical or elongated circular shape along a cylinder row direction such that a short diameter of the opening of the collective exhaust port is smaller than or equal to the equivalent diameters of the exhaust ports of the one pair of cylinders before merging.

When gas of high temperature flows in a pipe, the amount of heat radiation from the gas is influenced by the surface area of the pipe, i.e., heat radiation surface area, the flow rate of the gas in contact with the wall surface of the pipe, the volume of the gas etc. In a state immediately after cold engine start-up, a relatively small amount of exhaust gas alternately discharged from two cylinders tries to flow through or around the center of the cross section of the pipe with some distance away from the low-temperature wall surface of the pipe. The heat radiation amount is consequently set small as the equivalent diameters of the collective exhaust port and the collective exhaust pipe are set large. The exhaust gas can be thus introduced to the catalytic converter, while being maintained at a high temperature, during cold engine start-up.

By contrast, the heat radiation surface area becomes slightly predominant in a state where a large amount of high-temperature exhaust gas flows in the high-wall-surface-temperature pipe, e.g., during high-load high-speed engine operation after engine warm-up. The heat radiation amount is particularly dependent on the outer surface area size of the collective exhaust pipe because the wall surface temperature of the exhaust pipe is close to the temperature of the exhaust gas. The surface area of the pipe, i.e., heat radiation area is increased with increase in the equivalent diameter of the pipe. The heat radiation surface area is further increased by flattening the collective exhaust pipe into an elliptical or elongated circular cross-sectional shape without setting the short diameter of the collective exhaust pipe to be larger than the equivalent diameters of the exhaust ports before merging. The heat radiation amount is consequently set large as the heat radiation surface area is set large. Thus, the temperature of the exhaust gas introduced to the catalytic converter through the collective exhaust pipe can be suppressed so as to avoid catalyst deterioration due to excessive high temperature. The cross-sectional shape of the collective exhaust pipe is basically equal to the shape of the opening of the collective exhaust port.

As mentioned above, the present invention is characterized in that the collective exhaust port is set large in equivalent diameter and is flattened in shape such that the short diameter of the collective exhaust port is smaller than or equal to the equivalent diameters of the exhaust ports before merging. It is possible in this configuration to satisfy both of the mutually contradictory demands to introduce the exhaust gas to the catalytic converter, while maintaining the temperature of the exhaust gas as high as possible, during cold engine start-up and to suppress the temperature of the exhaust gas introduced to the catalytic converter during high-speed high-load engine operation.

DESCRIPTION OF EMBODIMENTS

Figure 1:
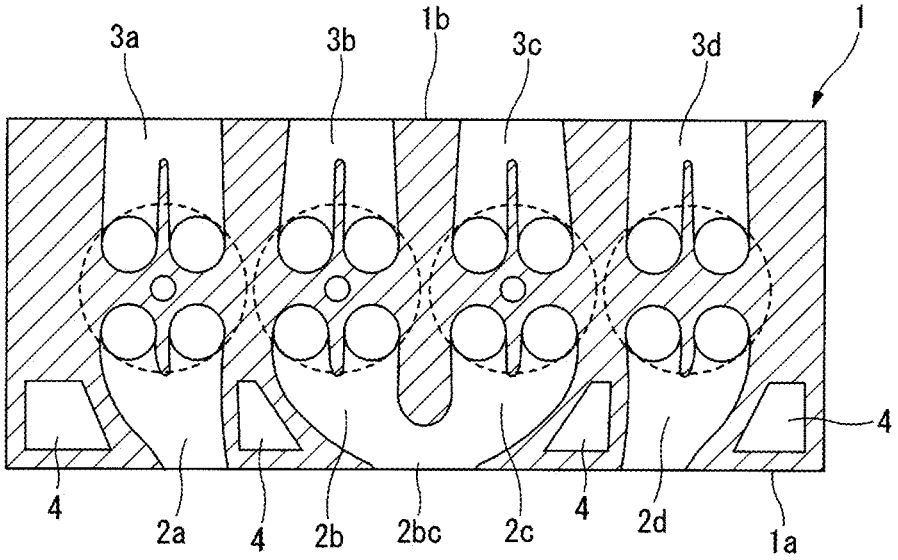
FIG. 1 is cross-sectional view of a cylinder head with an exhaust device according to a first embodiment of the present invention.
Figure 2:
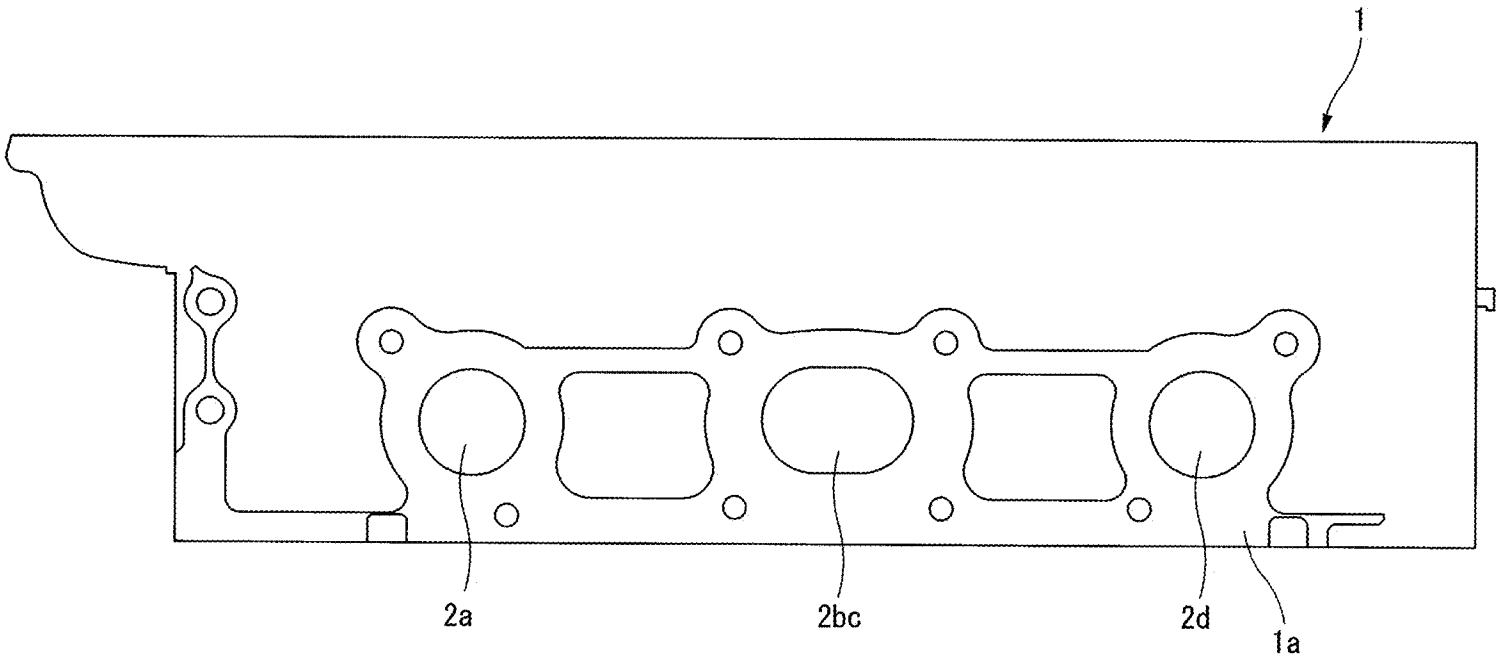
FIG. 2 is an exhaust-port side view of the cylinder head according to the first embodiment of the present invention.
Figure 3:
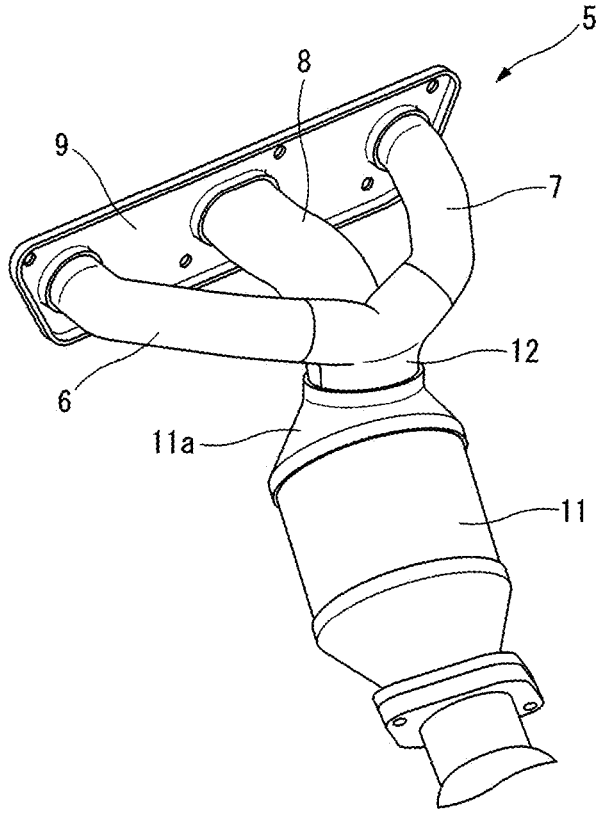
FIG. 3 is a perspective view of one example of an exhaust manifold mounted to the cylinder head.

FIGS. 1 to 3 shows an in-line four-cylinder internal combustion engine according to a first embodiment of the present invention. As shown in FIG. 1, exhaust ports 2*a* to 2*d* of first to fourth cylinders #1 to #4 extend toward one side surface 1*a* of cylinder head 1; and intake ports 3*a* to 3*d* of first to fourth cylinders #1 to #4 extend toward the other side surface 1*b* of cylinder head 1. Exhaust ports 2*a* and 2*d* of cylinders #1 and #4 are formed as respective separate individual exhaust ports each open at one side surface 1*a* of cylinder head 1. Exhaust ports 2*b* and 2*c* of cylinders #2 and #3 merge together inside cylinder head 1 to form one collective exhaust port 2*bc* open at one side surface 1*a* of cylinder head 1. Herein, the ignition timing of cylinder #2 and the ignition timing of cylinder #3 are 360° CA apart from each other so as not to cause exhaust interference between these cylinders. Water jacket 4 is provided in cylinder head 1 so as to surround the vicinities of exhaust ports 2*a* to 2*d* for forcible cooling by circulation of coolant.

FIG. 2 shows one side surface 1*a* of cylinder head 1. As illustrated in this figure, each of individual exhaust ports 2*a* and 2*d* of cylinders #1 and #4 has a substantially perfect circular opening. On the other hand, collective exhaust port 2*bc* of center cylinders #2 and #3 has an elliptical or elongated circular opening along the cylinder row direction. In the illustrated example, the opening of collective exhaust port 2*b* has an elongated circular shape with a linear middle region and opposite semicircular end regions. The equivalent diameter of the elongated circular opening of collective exhaust port 2*bc* is larger than the equivalent diameters of exhaust ports 2*b* and 2*c* of cylinders #2 and #3 before merging. Since the equivalent diameters of exhaust ports 2*b* and 2*c* of cylinder #2 and #3 are basically equal to the equivalent diameters of exhaust ports 2*a* and 2*d* of cylinders #1 and #4, the equivalent diameter of the opening of collective exhaust port 2*bc* is larger than the equivalent diameters of exhaust ports 2*a* and 2*d* of cylinders #1 and #4.

Further, the short diameter of the elongated circular opening of collective exhaust port 2*bc* in the vertical direction is smaller than or equal to the equivalent diameters of exhaust ports 2*b* and 2*c* of cylinders #2 and #3 before merging. For example, the short diameter of the opening of collective exhaust port 2*bc* is slightly smaller than the equivalent diameters of exhaust ports 2*b* and 2*c* before merging. Since the openings of individual exhaust ports 2*a* and 2*d* of cylinders #1 and #4 are perfect circular in shape and are basically equal in equivalent diameter to those of exhaust ports 2*b* and 2*c* of cylinder #2 and #3, the opening of collective exhaust port 2*bc* is slightly smaller in short diameter than the diameters of individual exhaust ports 2*a* and 2*d* and elongated circular in shape along the cylinder row direction at one side surface 1*a* of cylinder head 1. In one preferred embodiment, the ratio of the long diameter to the short diameter of the collective exhaust port is set to 1.6.

FIG. 3 shows an example of exhaust manifold 5 mounted to one side surface 1*a* of cylinder head 1. Exhaust manifold 5 includes #1 individual exhaust pipe 6 joined to individual exhaust port 2*a* of cylinder #1, #4 individual exhaust pipe 7 joined to individual exhaust port 2*d* of cylinder #4 and collective exhaust pipe 8 joined to center collective exhaust port 2*bc*. Base ends of these three exhaust pipes 6, 7 and S are supported by head mounting flange 9. Each of #1 individual exhaust pipe 6 and #4 individual exhaust pipe 7 has a substantially circular cross-sectional shape with an equivalent diameter basically equal to that of the opening of individual exhaust port 2*a*, 2*d* at one side surface 1*a* of cylinder head 1. Collective exhaust pipe 8 has an elongated circular cross-sectional shape along the cylinder row direction as corresponding to the opening of the collective exhaust port at one side surface 1*a* of cylinder head 1 so that the equivalent diameter and flatness degree of collective exhaust pipe 8 are basically equal to those of the opening of the collective exhaust port.

Tip ends of #1 individual exhaust pipe 6, #4 individual exhaust pipe 7 and collective exhaust pipe 8 are each connected to diffuser part 11*a*, which is located on an upstream side of single catalytic converter 11. Catalytic converter 11 has a cylindrical column-shaped monolith catalyst support accommodated in a cylindrical metal casing. Diffuser part 11*a* is substantially conical in shape so as to define a space of gradually increasing diameter between end surfaces of the catalyst support and diffuser part 11*a*.

Collective exhaust pipe 8 extends linearly from head mounting flange 9 in a direction perpendicular to the cylinder row direction, and has a tip end portion curved downward and connected to an upstream end portion of diffuser part 11*a*. At the connection between collective exhaust pipe 8 and catalytic converter 11, collective exhaust pipe 8 has a substantially semi-circular cross-sectional shape (although not specifically shown in the figures).

Both of #1 individual exhaust pipe 6 and #4 individual exhaust pipe 7, which are located on front and rear sides of the exhaust manifold in the cylinder row direction, extend in curved forms along the cylinder row direction so as to be substantially symmetrical in shape when viewed in plan, and have respective tip end portions curved downward and connected to the upstream end portion of diffuser part 11*a*. More specifically, #1 individual exhaust pipe 6 and #4 individual exhaust pipe 7 merge together into a substantially Y- or T-shape at a point immediately adjacent to catalytic converter 11 and thereby make connection between one merged connection pipe part 12 and diffuser part 11*a*. At the connection between connection pipe part 12 and catalytic converter 11, connection pipe part 12 has a substantially semi-circular cross-sectional shape symmetrical to that of the end portion of collective exhaust pipe 8 (although not specifically shown in the figures).

As shown in FIG. 3, collective exhaust pipe 8 is arranged on the inner side closer to cylinder head 1; and individual exhaust pipes 6 and 7 are arranged so as to extend over the upper side or outer side of collective exhaust pipe 8. The passage lengths of both collective exhaust pipe 8 and individual exhaust pipes 6 and 7 are set as long as possible.

Figure 6:
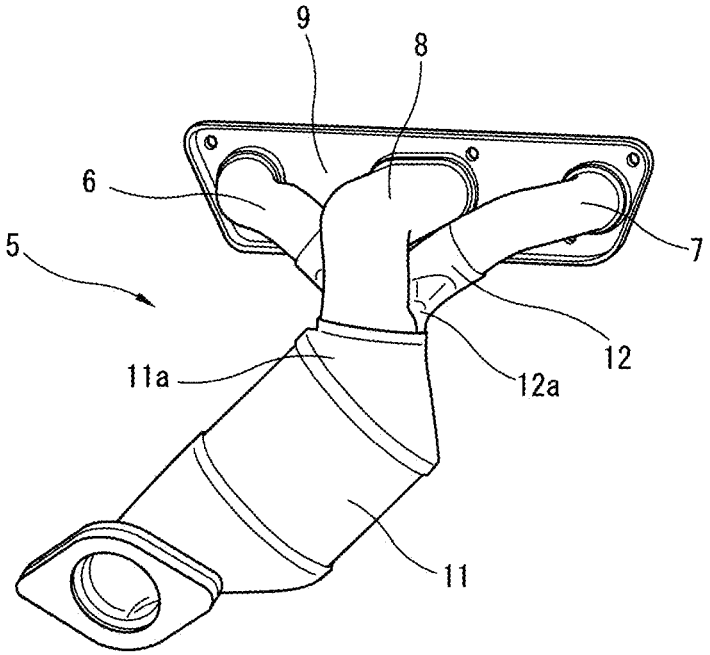
FIG. 6 is a perspective view of another example of the exhaust manifold.

Exhaust manifold 5 may alternatively be configured such that collective exhaust pipe 8 extends over the upper sides or lower sides of individual exhaust pipes 6 and 7 as shown in FIG. 6.

In the above-mentioned first embodiment, exhaust gas of cylinders #1 and #4 flows to catalytic converter 11 through individual exhaust ports 2*a* and 2*d* and individual exhaust pipes 6 and 7; and exhaust gas of cylinders #2 and #3 flows to catalytic converter 11 through common collective exhaust port 2*bc* and common collective exhaust pipe 8. Accordingly, the exhaust gas of cylinders #2 and #3 can be introduced to catalytic inverter 11 while being maintained at a relatively high temperature during cold engine start-up. This contributes to early catalyst activation. As already mentioned before, the exhaust device with the collective exhaust port has the drawback that the temperature of the exhaust gas tends to become too high during high-speed high-load engine operation after engine warm-up. It is however possible in the above-mentioned first embodiment to suppress the temperature of the exhaust gas during high-speed high-load engine operation after engine warm-up, without losing the ability to maintain the temperature of the exhaust gas after cold engine start-up, by forming collective exhaust port 2*bc* into a flattened shape with a large equivalent diameter.

Figure 4:
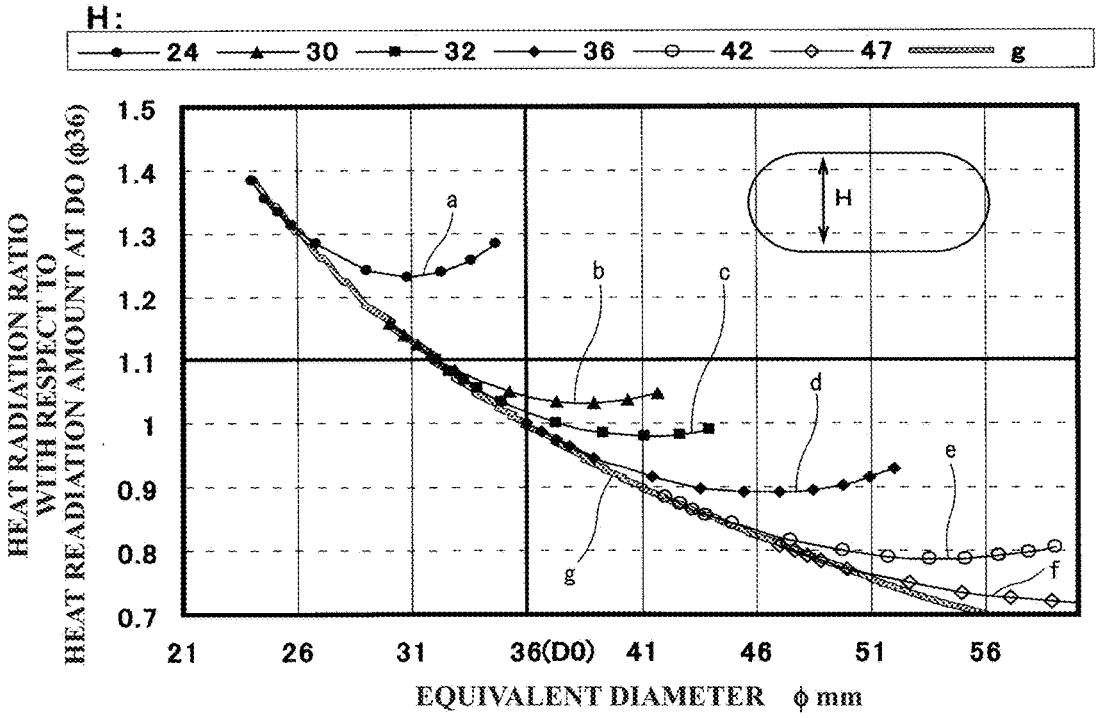
FIG. 4 is a characteristic diagram showing a relationship between exhaust port equivalent diameter and heat radiation amount during cold engine operation.

FIG. 4 shows a relationship between the equivalent diameter and heat radiation amount of the exhaust port during engine cold start-up. In FIG. 4, the horizontal axis represents the equivalent diameter of the exhaust port in terms of the change with respect to a certain reference equivalent diameter value V0 (e.g. 36 mm); and the vertical axis represents the heat radiation amount in terms of the change ratio with respect to the heat radiation amount at the reference equivalent diameter value V0. Herein, characteristic lines a to f indicate respective characteristics when the short diameter of the exhaust port varies within the range of 24 mm to 47 mm; and curve g, obtained by connecting points of the characteristic lines a to f corresponding to the case of the perfect circular shape, indicates an overall trend irrespective of the flatness degree. It is now assumed that a relatively small amount of exhaust gas flows through the exhaust port in a state after cold engine start-up (e.g. engine idling state) where the inner wall temperature of the exhaust port is low. When the equivalent diameter of the exhaust gas is large, the small amount of exhaust gas flows in the vicinity of the center of the exhaust port with not much contact with the low-temperature inner wall surface of the exhaust port. As a consequence, the heat radiation amount is decreased with increase in the equivalent diameter as shown in FIG. 4. In the above-mentioned first embodiment, the equivalent diameter of collective exhaust port 2*bc* is set larger than the equivalent diameters of individual exhaust ports 2*b* and 2*c*. The exhaust gas of the respective cylinder alternately flows as an intermittent gas flow through the collective exhaust port. It is thus possible to suppress the cooling of the exhaust gas after cold engine start-up and achieve early catalyst activation. The same goes for collective exhaust pipe 8.

Figure 5:
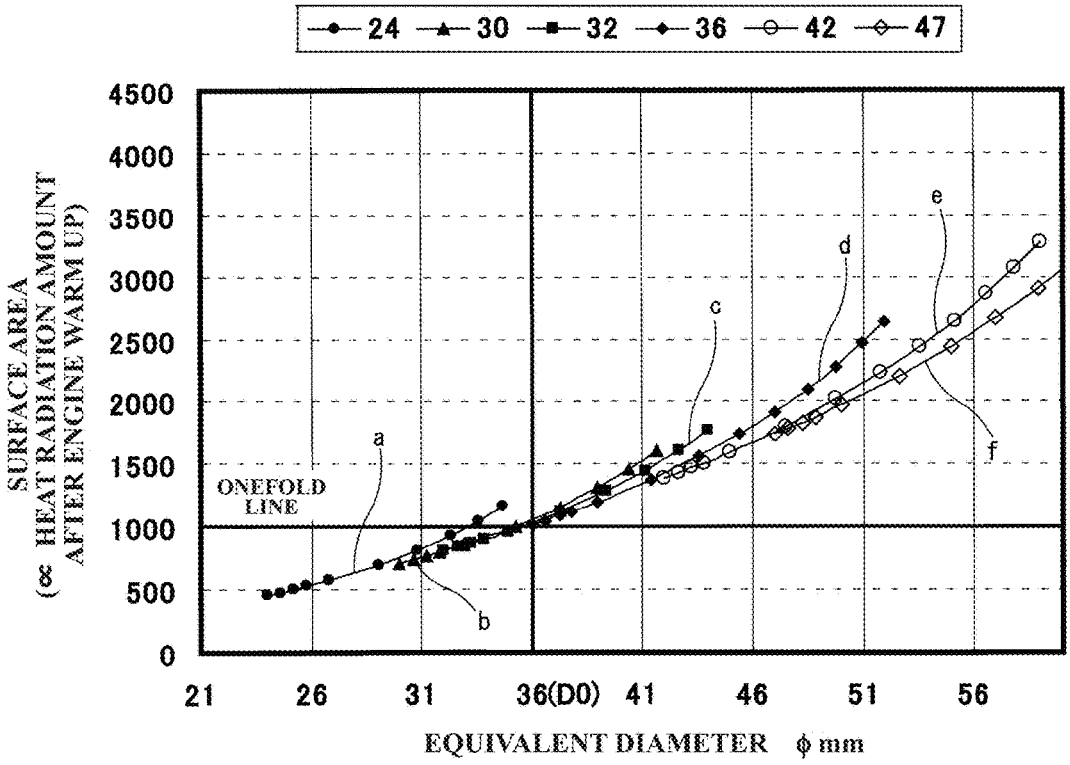
FIG. 5 is a characteristic diagram showing a relationship between exhaust port equivalent diameter and flatness/heat radiation surface area.

FIG. 5 shows a relationship between the equivalent diameter and heat radiation amount (passage surface area) of the exhaust pipe during high-speed high-load engine operation after engine warm-up. In FIG. 5, the horizontal axis represents the equivalent diameter of the exhaust pipe in terms of the change with respect to a certain reference equivalent diameter value V0 (e.g. 36 mm); and the vertical axis represents the heat radiation amount in terms of the change with respect to the heat radiation amount of the perfect circular exhaust pipe on the assumption that the heat radiation amount is proportional to the surface area of the exhaust passage. Herein, characteristic lines a to f indicate respective characteristics when the short diameter of the exhaust pipe varies within the range of 24 mm to 47 mm. As shown in FIG. 5, the larger the equivalent diameter, the larger the passage surface area, the larger the heat radiation amount, irrespective of the flatness degree. This is because, during high-speed high-load engine operation after engine warm-up, a large amount of exhaust gas flows in contact with the inner wall surface of the exhaust passage under a condition where the difference between the passage inner wall temperature and the exhaust gas temperature is small, so that the heat radiation amount varies depending on the surface area size of the exhaust pipe surface as the heat radiation surface. As is apparent from comparison of the characteristic lines a to f, the heat radiation amount (passage surface area) is increased as the flatness degree becomes higher at the same equivalent diameter. In the above-mentioned first embodiment, collective exhaust port 2*bc*, or equivalently, collective exhaust pipe 8 is formed with a large equivalent diameter and high flatness degree. It is thus possible to effectively cool the exhaust gas with the coolant or air and suppress the excessive temperature rise of the exhaust gas during high-speed high-load engine operation.

In this way, it is possible in the above-mentioned first embodiment to not only suppress the cooling of the exhaust gas and achieve early catalyst activation during cold engine start-up, but also suppress the excessive temperature rise of the exhaust gas, which can cause the problem of catalyst deterioration etc., during high-speed high-load engine operation after engine warm-up.

The temperature of the exhaust gas after cold engine start-up is maintained at the highest level when the ratio of the long diameter to the short diameter of the collective exhaust port as an index of flatness degree is in the vicinity of 1.6. When this long-to-short diameter ratio is 1.6 or higher, it is advantageous in terms of the heat radiation amount after engine warm-up. Thus, the long-to-short diameter ratio of the collective exhaust port is preferably set to 1.6 or higher.

Figure 7:
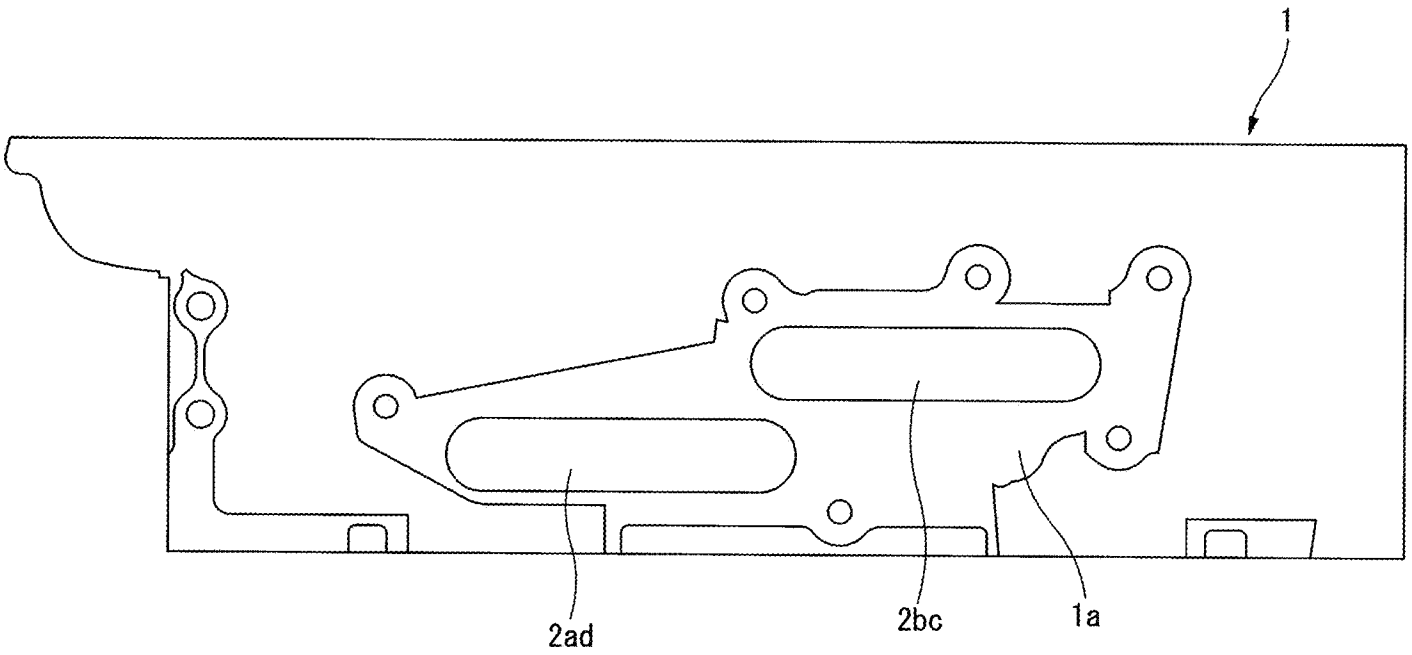
FIG. 7 is a side view of a cylinder head with an exhaust device according to a second embodiment of the present invention.

Next, an exhaust device according to a second embodiment of the present invention will be explained below with reference to FIG. 7. In the above-mentioned first embodiment, exhaust ports 2*b* and 2*c* of cylinders #2 and #3 merge together to form collective exhaust port 2*bc*; and exhaust ports 2*a* and 2*d* of cylinders #1 and #4 are formed as respective separate individual exhaust ports. In the second embodiment, exhaust ports 2*a* and 2*d* of cylinders #1 and #4 also merge together inside cylinder head 1 to form second collective exhaust port 2*ad* as shown in FIG. 7. Namely, the exhaust device has first collective exhaust port 2*bc* into which exhaust ports of cylinders #2 and #3 merge together and second collective exhaust port 2*ad* into which exhaust ports of cylinders #1 and #4 merge together. As shown in FIG. 7, these first and second collective exhaust ports have respective openings at one side surface 1*a* of cylinder head 1. The openings of collective exhaust ports 2*bc* and 2*ad* have an elliptical or elongated circular (in the illustrated example, elongated circular) shape along the cylinder row direction. The equivalent diameter of each of the openings of collective exhaust ports 2*bc* and 2*ad* is larger than the equivalent diameters of the respective exhaust ports of the corresponding two cylinders before merging. The short diameter of each of the openings of collective exhaust ports 2*bc* and 2*ad* is smaller than or equal to the equivalent diameter of the respective exhaust ports of the corresponding two cylinders before merging. Further, first and second collective exhaust ports 2*bc* and 2*ad* are arranged at different positions in the vertical direction so as to, when viewed in the cylinder row direction, at least partially overlap each other. In the illustrated example, first collective exhaust port 2*bc* is relatively located on the upper side.

Although not specifically shown in the figure, the exhaust manifold has two collective exhaust pipes corresponding in shape and arrangement to the exhaust port openings of FIG. 7.

In the above-mentioned second embodiment, first collective exhaust port 2*bc* and second collective exhaust port 2*ad* are located vertically adjacent to each other via the common partition wall. It is thus possible to advantageously ensure the high exhaust gas temperature after cold engine start-up.

The invention claimed is:

1. An exhaust device for a four-cylinder internal combustion engine, the internal combustion engine having first to fourth cylinders, at least one pair of which are 360° apart in ignition timing, the exhaust device comprising:

a collective exhaust port into which exhaust ports of the one pair of cylinders merge together inside a cylinder head, the collective exhaust port having an opening at one side surface of the cylinder head; and a collective exhaust pipe joined to the collective exhaust port, the collective exhaust pipe and an exhaust pipe for other one of the cylinders being connected to a single catalytic converter, wherein an equivalent diameter of the opening of the collective exhaust port is larger than equivalent diameters of the exhaust ports of the one pair of cylinders before merging;

wherein the opening of the collective exhaust port has an elliptical or elongated circular shape along a cylinder row direction such that a short diameter, which is along a direction perpendicular to the cylinder row direction, of the opening of the collective exhaust port is smaller than the equivalent diameters of the exhaust ports of the one pair of cylinders before merging.

2. The exhaust device for the four-cylinder internal combustion engine according to claim 1, wherein the ratio of a long diameter, which is along the cylinder row direction, of the opening to the short diameter of the opening is 1.6 or higher.

3. The exhaust device for the four-cylinder internal combustion engine according to claim 1, wherein the exhaust ports of the second and third cylinders merge together as the collective exhaust port; and wherein the exhaust ports of the first and fourth cylinders are formed as separate individual exhaust ports respectively open at the one side surface of the cylinder head and connected to the catalytic converter through respective separate individual exhaust pipes.

4. The exhaust device for the four-cylinder internal combustion engine according to claim 1, wherein the exhaust ports of the second and third cylinders merge together as a first collective exhaust port; and wherein the exhaust ports of the first and fourth cylinders merge together as a second collective exhaust port.

5. The exhaust device for the four-cylinder internal combustion engine according to claim 4, wherein the first collective exhaust port and the second collective exhaust port are arranged at different height positions in a vertical direction at the one side surface of the cylinder head such that the first collective exhaust port and the second collective exhaust port at least partially overlap each other in the cylinder row direction.

* * * * *